US010890050B2

(12) United States Patent
Tveranger et al.

(10) Patent No.: US 10,890,050 B2
(45) Date of Patent: Jan. 12, 2021

(54) SELF-CALIBRATING DEVICE FOR ACTIVATING DOWNHOLE TOOLS AND/OR OPERATIONS

(71) Applicant: TCO AS, Bergen (NO)

(72) Inventors: Jan Tore Tveranger, Garnes (NO); Bård Nerdal, Nyborg (NO)

(73) Assignee: TCO AS, Bergen (NO)

( * ) Notice: Subject to any disclaimer, the term of this patent is extended or adjusted under 35 U.S.C. 154(b) by 228 days.

(21) Appl. No.: 16/303,908

(22) PCT Filed: May 23, 2017

(86) PCT No.: PCT/NO2017/050129
§ 371 (c)(1),
(2) Date: Nov. 21, 2018

(87) PCT Pub. No.: WO2017/204658
PCT Pub. Date: Nov. 30, 2017

(65) Prior Publication Data

US 2020/0284123 A1 Sep. 10, 2020

(30) Foreign Application Priority Data

May 25, 2016 (NO) ..... 20160892

(51) Int. Cl.
*E21B 34/14* (2006.01)
*E21B 34/10* (2006.01)
(Continued)

(52) U.S. Cl.
CPC ..... *E21B 34/10* (2013.01); *E21B 23/04* (2013.01); *E21B 34/14* (2013.01); *E21B 41/00* (2013.01);
(Continued)

(58) Field of Classification Search
CPC ..... E21B 34/14; E21B 34/10; E21B 34/063; E21B 2200/04; E21B 2200/06; E21B 23/04
See application file for complete search history.

(56) References Cited

U.S. PATENT DOCUMENTS 5,518,073 A * 5/1996 Manke ..... E21B 23/006 166/240
6,145,595 A * 11/2000 Burris, II ..... E21B 34/108 166/374
(Continued)

FOREIGN PATENT DOCUMENTS

NO 20140616 A1 5/2014
WO WO1997/006344 A1 2/1997

OTHER PUBLICATIONS

International Search Report and Written Opinion dated Sep. 4, 2017 for International patent application No. PCT/NO2017/050129, filed on May 23, 2017.

*Primary Examiner* — Michael R Wills, III
(74) *Attorney, Agent, or Firm* — Chamberlain Hrdlicka

(57) ABSTRACT

A tool activation device that includes a pressure inlet port configured to be in communication with a wellbore pressure, a housing that includes a counter mechanism with a first counter end and a second counter end, where the counter mechanism includes a closed chamber filled with a fluid having a pressure, and a ratchet system that includes a ratchet piston with a first ratchet end in pressure communication with the pressure inlet port and a second ratchet end in communication with the closed chamber, a valve mechanism interconnecting the pressure inlet port and the closed chamber arranged for equalizing the pressure a cross the ratchet piston.

20 Claims, 3 Drawing Sheets

(51) Int. Cl.

| | |
|---|---|
| ***E21B 23/04*** | (2006.01) |
| ***E21B 41/00*** | (2006.01) |
| *E21B 34/06* | (2006.01) |

(52) U.S. Cl.
CPC ..... *E21B 34/063* (2013.01); *E21B 2200/04* (2020.05); *E21B 2200/06* (2020.05)

(56) References Cited

U.S. PATENT DOCUMENTS

| | | | | |
|---|---|---|---|---|
| 7,926,575 | B2 * | 4/2011 | Ringgenberg | E21B 23/006 166/375 |
| 2011/0146265 | A1 | 6/2011 | Joseph et al. | |
| 2013/0118758 | A1 | 5/2013 | Caminari | |
| 2013/0186633 | A1 | 7/2013 | Kitzman | |
| 2015/0000982 | A1 * | 1/2015 | McDowell | F16K 3/03 175/57 |

* cited by examiner

SELF-CALIBRATING DEVICE FOR ACTIVATING DOWNHOLE TOOLS AND/OR OPERATIONS

FIELD OF THE INVENTION

The invention relates to a self-calibrating device for activating downhole tools and/or operations.

BACKGROUND OF THE INVENTION

The present invention relates to a device for activating a downhole tool or function, where said device can be connected to a pipe section of a pipe arranged in a well in a formation.

The invention relates particularly, but not exclusively, to a new construction for a release body/tool for use in a well enabling activation of various well equipment to initiate a necessary action, and where the equipment is activated by pulsing or cycling the pressure of the fluid that is in the well. Normally, such tools are constructed by a counting and step construction (counter system) where a piston or the like displaces a toothed rod, ratchet, shaft or the like a given distance each time the operator on the surface increases the fluid pressure in the well, with such a pressure increase being followed by a pressure release. When the rod, after a given number of such pulses with high/low fluid pressure, has been moved a sufficient distance forwards, activation of various equipment in a hydrocarbon well is enabled.

Such a function, which brings about a uniform movement, is often referred to as a ratchet function, and is, for example, described in WO 2011065843 A1 in connection to a fluid-operated valve body. A pipe section is exposed to a pipe fluid pressure at its one end and moves a predetermined step with the cycle of increasing and decreasing of the pipe fluid pressure. After a predetermined number of pressure cycles, the mechanism brings about the opening of a plunger piston which furthermore enables fluid communication to a fluid operated tool.

Another example of a tool with a step/counting function and which releases an appliance after a given number of pressure pulses is described in Norwegian patent 325899.

If the activation is dependent on the fluid pressure reaching a given upper level only, the time of the release is more difficult to predict. Also, conventional counter systems largely must be customized to specific well conditions since conventional counter systems are pressure-sensitive and may fail to work if pressure conditions in a well change or are otherwise outside the pressure intervals under which the customized trigger system is set to work.

With the help of the counter system, the time of activation can be accurately predicted as it is based on the number of steps up to the release and not on the level of fluid pressure. However, these systems can still be improved.

Examples of such well tools that can be activated are valves, gasket systems (packers), sliding sleeves, different types of toe sleeves etc. These tools are normally operated by pressurizing the pipe which they are fitted into to form a part thereof a predetermined number of times from the surface. This is achieved through different types of valve systems that have been set up and react to pressure variations when these control mechanisms have registered (seen) the correct sequence, whereupon they open up for the well pressure and let the fluid in, and the tool can be operated.

Other applications for which the invention is suitable include the opening of a valve, the detonation of an explosive charge, the removal of a plug or other downhole elements, etc.

Customizing a trigger system is a time-demanding operation, as each tool must be calibrated for the specific well conditions. In addition, well conditions may change, thereby moving the pressure and temperature conditions outside the operating pressure window of the trigger systems.

Today's systems also require that the pipe has a higher material thickness to solve the problem, as one traditionally needs to use a very powerful spring or a nitrogen chamber to compensate for the hydraulic fluid pressure of the well.

Therefore, it is an aim of the invention to provide a new construction that can eliminate the need for calibration of the tool for each individual well in which the equipment is to be used.

Furthermore, it is an aim to provide a system that is self-calibrating based on hydrostatic pressure.

Furthermore, it is an aim to be able to contribute to maintaining the pressure that must be applied from the surface to the pipe at the same level, regardless of the depth in which the tool is fitted.

Then, the tools may be mass-produced in a simple manner and calibrated such that they will always be required to supply a pressure of, for example, 100 bar at the surface independent of the hydrostatic pressure.

Furthermore, it is an aim to provide a solution that, once the correct number of pressure pulses has been applied, the system will activate the actual tool which is to be operated.

At least one of these aims is achieved by the device indicated in the enclosed independent claim 1. Other favorable or possible embodiments are indicated in the dependent claims.

SUMMARY OF THE INVENTION

It is provided a tool activation device a housing comprising a pressure inlet port configured to be in communication with a wellbore pressure (P1) a housing comprising a counter mechanism with a first end and a second end, wherein the counter mechanism comprises a closed chamber filled with a fluid having a pressure (P2), and a ratchet means comprising a ratchet piston with a first end in pressure communication with the pressure inlet port and a second end in communication with the closed chamber, a valve mechanism interconnecting the pressure inlet port and the closed chamber arranged for equalizing the pressure a cross the ratchet piston.

In one embodiment the wherein the valve mechanism comprises a first one-way valve and a second one-way valve each having one end in fluid communication with the closed chamber and another end in pressure communication with the inlet port, wherein the first and the second one-way valves are arranged in opposite directions. The first and the second valves are configured to equalize pressure in the closed chamber when a predetermined differential pressure value between P1 and P2 is exceeded. In one embodiment the first and the second valves are one-way relief valves. The fluid in the closed chamber is a compressible fluid.

In one embodiment the counter mechanism further comprises a ratchet movably connected to the ratchet piston, a retaining clip and a retaining member configured to limit movement of the ratchet towards the pressure inlet port. In one embodiment the counter mechanism further comprises a retaining shoulder configured to limit the movement of the ratchet piston towards the closed chamber. In one embodiment the ratchet piston is configured to move the ratchet in a direction towards an activation pin and move freely in the opposite direction.

In one embodiment, the tool activation device further comprises an activation pin, wherein the activation pin is arranged to activate a tool located in a wellbore. The activation pin is arranged to be activated by the ratchet.

In one embodiment, the first valve is configured to open when pressure (P1) at the pressure inlet port is a predetermined value greater than the fluid pressure (P2) in the closed chamber and the second valve is configured to open when the pressure (P1) at the pressure inlet port is a predetermined value less than the fluid pressure (P2) in the closed chamber. One embodiment the crack open pressure of the second valve is less than the crack open pressure of the first valve.

In one embodiment, the tool activation device further comprises a pressure equalization channel, which extends from the pressure inlet port and beyond the counter mechanism.

In one embodiment, the fluid in the closed chamber is a compressible fluid, preferably silicone oil.

In one embodiment the valve mechanism is arranged within the ratchet piston and the valve mechanism comprises a valve configured to prevent fluid flow in a first direction from pressure inlet port to the closed chamber and allow fluid flow in a second opposite the first direction. The valve may be one-way relief valve or may be a check valve. In one embodiment the valve comprises a ball arranged to rest on a seat and the valve is configured to open when the ball is moved away from the seat.

There is also provided a method of activating a downhole tool with a tool activation device comprising: a pressure inlet port; a housing comprising, a counter mechanism with a first end and a second end, wherein the counter mechanism comprises a closed chamber filled with a fluid having a pressure, and a ratchet means comprising a ratchet and a ratchet piston with a first end in pressure communication with the pressure inlet port and a second end in communication with the closed chamber, a valve mechanism interconnecting the pressure inlet port and the closed chamber, the method comprising the steps of;

a) increasing wellbore pressure (P1) at the pressure inlet port to push the ratchet means towards an activation pin whereby the ratchet piston compresses the fluid in the closed chamber, and to move the ratchet to a new position, b) retaining the ratchet in the new position by the retaining mechanism;

c) continue increasing wellbore pressure (P1) in such that P1 is a predetermined pressure difference greater than the fluid in the closed chamber (P2);

In one embodiment the method further comprises;

d) open a first valve of the valve mechanism to equalize pressure across the ratchet piston by allowing fluid into the closed chamber;

e) decreasing the wellbore pressure (P1) a predetermined pressure difference lower than the fluid in the closed chamber (P2);

f) open a second valve of the valve mechanism to equalize pressure across the ratchet piston by releasing fluid from the closed chamber;

g) repeating steps a) to f) until the ratchet shaft engages with the activation pin and forces the activation pin from its position and activate the downhole tool.

In one embodiment, the method in step f), the ratchet piston is pushed back to its start position and the ratchet is retained by the retaining mechanism.

In one embodiment the method further comprises, after step c, the steps of;

h) decreasing the wellbore pressure (P1) lower than the fluid in the closed chamber (P2);

i) open a valve of the valve mechanism to equalize pressure across the ratchet piston by releasing fluid from the closed chamber;

j) repeating steps (a-c) and (h j) until the ratchet shaft engages with the activation pin and forces the activation pin from its position to activate the downhole tool.

BRIEF DESCRIPTION OF THE DRAWINGS

These and other possible alternative or advantageous embodiments of the invention will become clear from the following detailed description of an embodiment, given as non-limiting examples, with reference to the attached schematic drawings, wherein.

DETAILED DESCRIPTION

Figure 1:
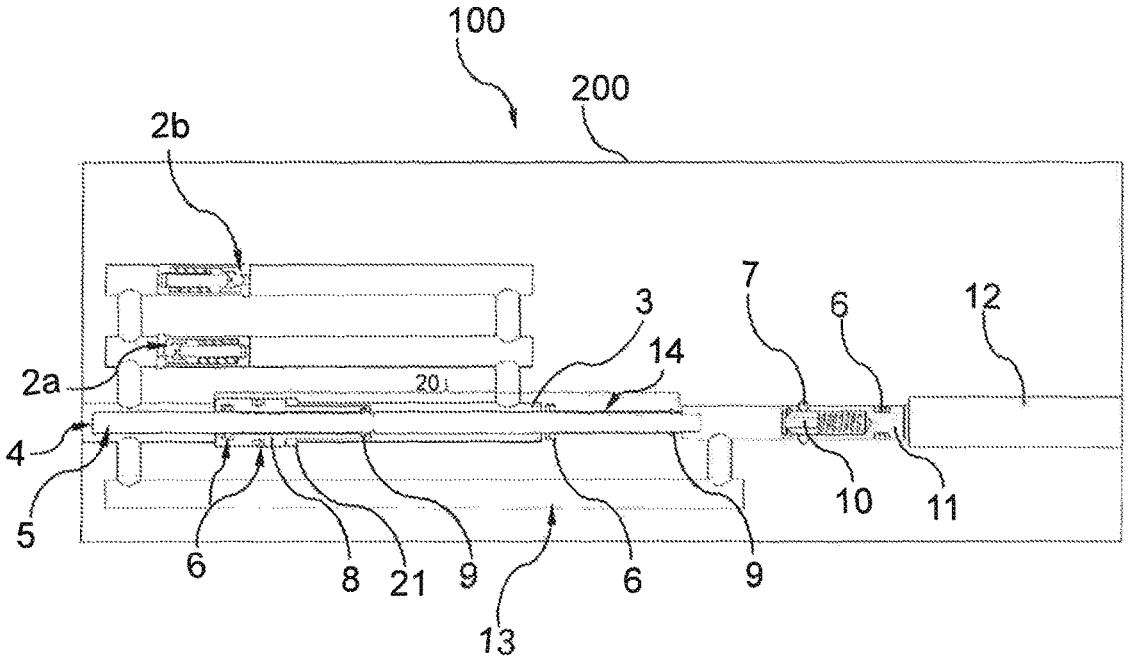
FIG. 1 shows the device according of the invention.

The following description may use terms such as "horizontal", "vertical", "lateral", "back and forth", "up and down", "upper", "lower", "inner", "outer", "forward", "rear", etc. These terms generally refer to the views and orientations as shown in the drawings and that are associated with normal use of the invention. The terms are used for the reader's convenience only and shall not be limiting.

In one embodiment of the invention, the tool activation device 100 is shown in FIG. 1. The device 100 comprises an inlet pressure port 4 in communication, a housing 300 defining a housing bore comprising a valve mechanism comprising a first valve 2*a* in communication with the inlet pressure port 4 and a closed chamber 3 filled with a compressible fluid, a second valve 2*b* in communication with the closed chamber 3 and the inlet pressure port 4. The inlet pressure port 4 is configured to be in communication with a wellbore pressure (P1) which may be manipulated from a rig, vessel or by a pressure manipulator in/on a wellhead. The device further comprises a pressure equalization channel 13, a counter mechanism 20 comprising a ratchet 5 and a ratchet piston 8, a plurality of O-rings 6, locking elements 7, a retaining clip 9, a retaining member 14, an activation pin 10, an activation outlet or pin 11 and a tool activation port 12. The valves may be one-way relief valves arranged in opposite directions. The valves may also be check valves. The ratchet 5 may be a single unit or may comprise a plurality of units that are welded or mounted together.

The device is insensitive to changes in hydrostatic pressures; this is achieved by the valves and the compressible fluid in the closed chamber. One function of the pressure equalization channel 13 may be to eliminate pressure buildup between the rear of the device and the front of the device. Another function of the pressure equalization channel 13 may be to eliminate backward movement of the ratchet 5 caused by a pressure increase at the front end of the ratchet 5. The pressure at the front end of the ratchet 5 is arranged to be equal to the pressure at the inlet port 4, which is achieved by means of the pressure equalization channel 13. The inlet pressure port 4 is in communication with a wellbore pressure P1 which may be manipulated from a remote location. The pressure equalization channel 13 extends from the proximity of the pressure inlet port 4 and further beyond the ratchet 5.

Figure 2:
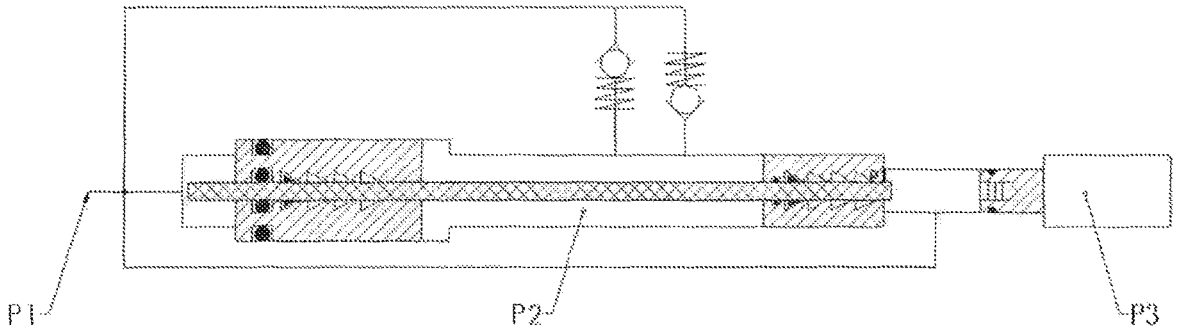
FIG. 2 is a simplified hydraulic diagram of the first embodiment of the invention.

FIG. 2 shows a simplified hydraulic diagram of the invention. The figure shows a pressure, P1, which is the pressure at the rear of the device 100 (wellbore pressure), rear in this regard being the left side. The pressure equalization channel 13 extends from the pressure inlet port 4 and beyond the counter mechanism 20. The pressure equalization channel 13 avoids pressure buildup between the front and the rear of the device 100. P1 is the pressure that is being manipulated by increasing and decreasing it. It should be understood that other means to avoid pressure buildup in the rear front of the device 100 may be possible, i.e. a pressure/volume compensating device/arrangement. In one embodiment, the pressure equalization channel 13 may comprise a valve arrangement in order to control pressure equalization between the front and the rear of the device and/or relay well pressure to other components/chambers/devices.

P2, which is shown in FIG. 2, is the pressure in the closed chamber 3. When the pressure at the rear of the device, P1, is increased, the ratchet piston 8 and the ratchet 5 move inward and start to compress the fluid in the closed chamber 3. The pressure in the closed chamber 3 increases as a result of this fluid compression. When the pressure difference between P1 and P2 exceeds a predetermined value, the first valve 2*a* opens to equalize this pressure difference. When the pressure at rear of the device, P1, is decreased and a predetermined pressure difference between P1 and P2 is exceeded, the second valve 2*b* opens to equalize the pressure difference. The backward and the forward movements of the ratchet piston 8 are controlled by P1, P2 and the valves. This process will be explained in more detail below.

In FIG. 1, the counter 20 comprises the ratchet piston 8, the ratchet 5 which is movably connected to the ratchet piston 8, retaining clips 9 in contact with the exterior part of the ratchet 5 and a retaining member 14 in contact with the front end of the ratchet. Both the retaining clips 9 and the retaining member 14 act/serve to limit backward movement of the ratchet 5. The counter 20 further comprises a retaining shoulder 21 for restricting movement of the ratchet piston 8 and a closed chamber 3 filled with a compressible fluid. The ratchet piston 8 is configured to displace the ratchet 5 in a direction towards the front end of the counter mechanism (inward) and move freely in the other direction (outward). The compressible fluid in the closed chamber 3 is a compressible liquid, preferably silicone oil. The counter mechanism 20 may further comprise resilent elements (not shown) located behind the ratchet piston 8 or behind the ratchet 5.

When pressure P1 is increased, the ratchet piston 8 is forced to move inward, compressing the fluid in the closed chamber 3. As the ratchet piston 8 moves inward, it displaces the ratchet 5 inward. As the pressure (P1) is increased, the ratchet piston 8 moves until it is retained by the retaining shoulder 21. The pressure, P1, continues to increase until a predetermined differential pressure value (P1-P2) is exceeded. The first valve 2*a* is configured to open when this predetermined differential pressure value is exceeded. This results in a fluid influx in the closed chamber 3 and pressure equalization in the closed chamber 3 is achieved. After pressure equalization is achieved, the ratchet piston 8 is moved back to its original position (outward). This is achieved by decreasing P1 and opening the second valve 2*b*. P1 is decreased until a predetermined differential pressure value between P1 and P2 is exceeded. The second valve 2*b* is configured to open when this predetermined differential pressure value (P2-P1) is exceeded. This results in fluid decompression and fluid outflux from the closed chamber 3 and pressure equalization between P1 & P2.

Outward movement (direction towards the rear of the counter mechanism) of the ratchet piston 8 is achieved when P2 exceeds P1, but before exceeding the predetermined differential pressure to open the second valve 2*b*. As the ratchet piston 8 moves outward, the ratchet 5 is retained by the retaining rings 9 and the retaining member 14, thereby achieving outward movement of the ratchet piston 8 only. One pressure cycle is completed when the ratchet piston 8 is moved back to its original position. This process is repeated until the ratchet 5 reaches an activation pin 10 which activates the device to be used/operated. The ratchet 5 moves towards the activation pin 10 for every pressure cycle until it reaches the activation pin 10.

The valves 2*a,b* are configured to equalize pressure in the closed chamber 3. The valves operate in opposite directions and open at a predetermined differential pressure. The term "predetermined" means a pressure value that is preset by the manufacturer or the user. Differential pressure in this regard means a pressure difference between P1 and P2 or vice versa, P1–P2 or P2–P1. In the present application, the differential pressure may also be referred to as crack-open pressure. In one embodiment of the invention, the first valve 2*a* is configured to open when P1–P2=80 bar (crack-open pressure). When the crack-open pressure is exceeded, the valve opens to equalize the pressure in the closed chamber 3 by pumping more fluid into the chamber 3. In the same embodiment of the invention, the second valve 2*b* has a crack-open pressure of 20 bar (P2–P1=20 bar). As P2 exceeds P1, but before P2 exceeds the crack-open pressure of the second valve 2*b*, the ratchet piston 8 moves outward, because P2 is larger than P1. It should be understood that the pressure difference that is needed to achieve outward movement of the ratchet piston 8 should be greater than its frictional force. After P2 exceeds the crack-open pressure of the second valve (20 bar), the second valve 2*b* opens to equalize the pressure in the closed chamber by bleeding off fluid from the chamber 3. In this embodiment, the valves operate at crackopen pressures of 80 bar and 20 bar, respectively. It should be understood that the valves can be designed to operate at other crack-open pressures than the values used in this embodiment. The values used in this embodiment are presented for the reader's convenience and shall not be understood as limiting.

Due to the valves, the device according to this invention is self-calibrating. The device can be activated regardless of the pressure range in the well. The activation of the device is controlled by the differential pressure between the fluid in the closed chamber, P2, and the surrounding pressure, P1, which is remotely manipulated.

Figure 3A:
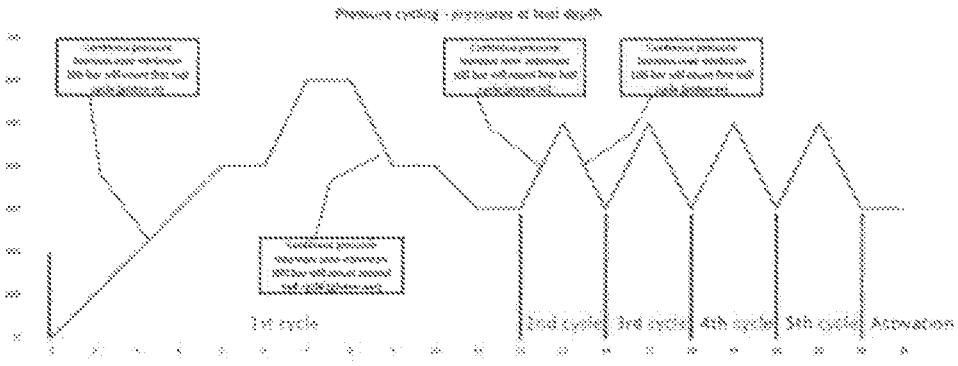
FIGS. 3*a* and 3*b* show a typical pressure cycle sequence of the first embodiment of the invention.

FIG. 3*a* shows an example of a typical pressure sequence that may be used to activate the device 100. During installation of the device 100, the device 100 is run at a desired depth in the well and the pressure P1 is manipulated i.e. from a rig or by a manipulator located on/in the wellhead. The pressure inlet port 4 is in communication with the wellbore pressure. After the device is installed at the desired depth, the wellbore pressure, P1, is increased. In one embodiment of the invention, P1 is increased (e.g. by at least 100 bar) to move the ratchet piston 8 inward, compressing the fluid in the closed chamber 3; this is counted as the first half-cycle. Then P1 is decreased (e.g. by at least 100 bar) to move the piston outward; this is counted as the second half-cycle. The first pressure cycle is now completed. In the second pressure cycle, P1 is increased again (e.g. by at least 100 bar) to move the ratchet piston 8 inward and decreased (e.g. by at least 100 bar) to move the ratchet piston 8 outward. This is repeated a predetermined number of times in order to activate the device to be operated. It should be understood that other pressure cycle values may be used to achieve the same results as in the embodiment described.

Figure 3B:
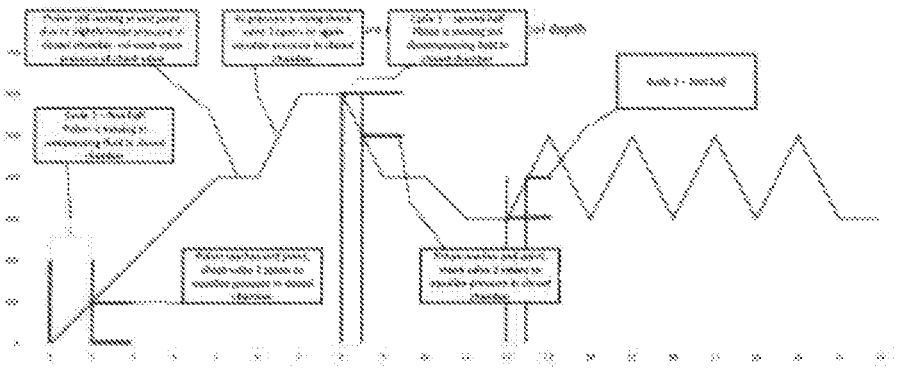

FIG. 3*b* shows an example of a typical pressure sequence. In FIG. 3*b* the inward and the outward movement of the ratchet piston 8 is shown. During the first half of the first pressure cycle, the ratchet piston moves inward, compressing fluid in the closed chamber. The ratchet piston moves until it is stopped by the retaining shoulder 21. Pressure P1 is still increased until the crack-open pressure of the first valve is exceeded, which then opens to equalize the pressure difference. During the second half of the first pressure cycle, the pressure P1 is decreased, and at the time P1 falls below P2, the ratchet piston 8 starts to move outward. As P1 continuous to decrease and the crack-open pressure of the second valve is exceeded, the valve opens to equalize the pressure in the closed chamber 3 by bleeding off excess fluid volume.

Figure 4:
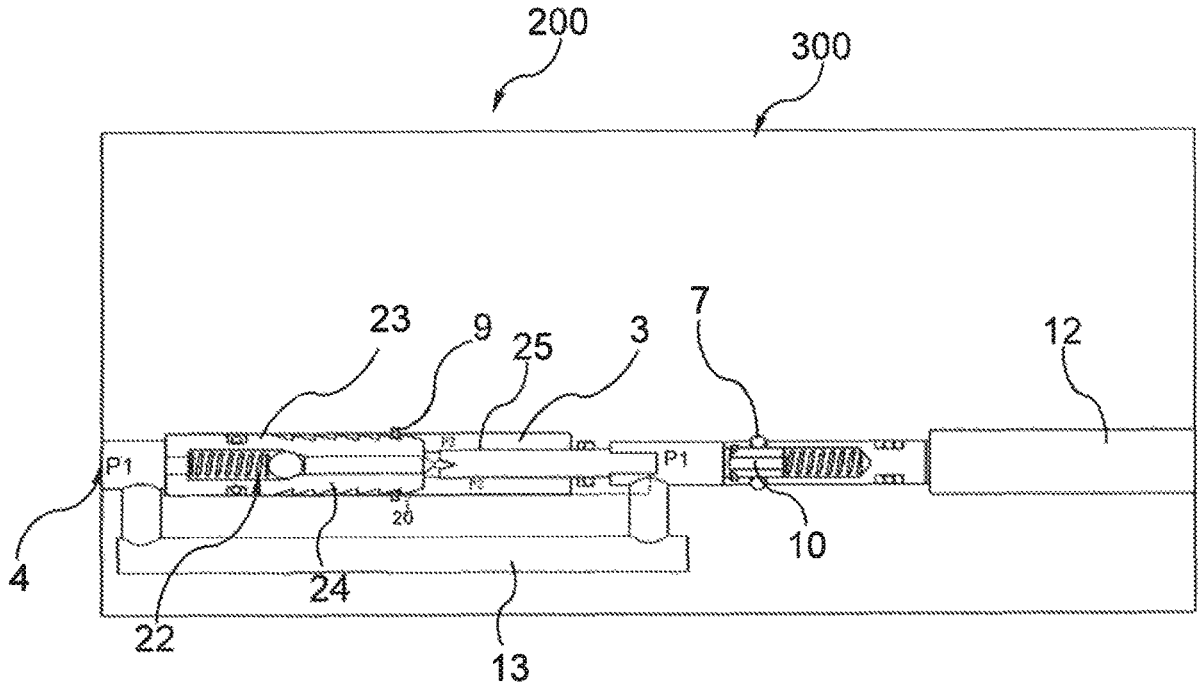
FIG. 4 shows another embodiment of the invention.

FIG. 4 shows another embodiment of the invention. The device 200 comprises a ratchet means 23 which comprises a ratchet piston 24 and a ratchet shaft 25. The ratchet piston 24 and the ratchet shaft 25 may be a single unit or different units welded together or attached to the each other by fastenings means. As in the first embodiment, the device 200 further comprises a pressure equalization channel 13, a housing 300, a plurality of O-rings, a locking member, a retaining clip 9, an activation pin 10, an activation outlet 11 and a tool activation port 12. These elements have the same functions as in the first embodiment. The device 200 further a valve mechanism interconnecting the pressure inlet port and the closed chamber and is arranged for equalizing the pressure a cross the ratchet piston 24. The valve mechanism comprises a valve 22 which may be one-way relief valve or a check valve. The valve 22 may be configured to prevent fluid flow in a first direction from pressure inlet port 4 to the closed chamber 3 and allow fluid flow in a second opposite the first direction. The valve mechanism may be arranged within the ratchet piston 24 or arranged behind the ratchet piston 24.

In the first pressure cycle, the pressure P1 at the inlet port is increased. When P1 is increased, the ratchet means 23 is pushed inward and starts to compress the fluid in the closed chamber 3. As the pressure (P1) continues to increase, the ratchet 23 moves further towards the activation pin 10 and will compress the compressible fluid in the closed chamber 3 until a further compression of the fluid is not achievable. The first pressure cycle is complete when the compressible fluid can no longer be compressed by increasing P1 and the pressure P2 in the closed chamber 3 is higher than its initial value. To further progress the ratchet means 23 towards the activation pin 10, it is preferable to reduce the fluid volume in the closed chamber 3. This is achieved by decreasing the pressure P1 to a value lower than pressure P2. As the pressure P1 decreases to a value lower than the pressure P2 in the closed chamber 3, the fluid in the closed chamber 3 forces the ratchet 23 to move backward towards the pressure inlet port 4. However, backward movement of the ratchet 23 is not desirable and is prevented by the retaining clip 9. The valve 22 is in fluid/pressure communication with the closed chamber 3 and is affected by the force of the compressible fluid, meaning that pressure is applied to the valve 22 by the compressible fluid. The valve 22 may comprise a ball resting on a seat which enables the valve 22 to open when the ball is moved away from its seat. The valve is configured to open when a predetermined pressure difference between P2 and P1, set by the user, is exceeded. Optionally, the valve 22 may be configured to open at a specific predetermined crack-open pressure. When the predetermined pressure difference between P2 and P1 set by the user is exceeded, the valve 23 opens. This results in fluid outflow from the chamber 3, and the pressure difference between P1 and P2 is equalized. After pressure equalization is achieved or nearly achieved, the pressure P1 is increased again to move the ratchet 23 further inward towards the activation pin 10. This pressure increase is counted as the second pressure cycle. As the pressure P1 increases, the ratchet 23 compresses the fluid in the closed and progresses further towards the activation pin 10, since there is less fluid in the closed chamber 3 than there was under the first pressure cycle. This pattern/process is repeated until the ratchet 23 initiates/activates the activation pin 10 and activates the tool that is to be operated or activated.

When the pressure changes due to temperature, depth or fluid weights, the closed chamber 3 will equalize to the wellbore pressure by means of the check valve 22 bleeding off excess volume, or the piston moves inward for volume compensation.

While the invention has been described with reference to the embodiment illustrated, it should be understood that modifications and/or additions can be made to the device, which remain within the field and scope of the invention.

What is claimed is:

1. A tool activation device comprising:

a pressure inlet port configured to be in communication with a wellbore pressure, a housing comprising, a counter mechanism with a first counter end and a second counter end, wherein the counter mechanism comprises:

a closed chamber filled with a fluid having a pressure, and a ratchet system comprising a ratchet piston with a first ratchet end in pressure communication with the pressure inlet port and a second ratchet end in communication with the closed chamber, a valve mechanism interconnecting the pressure inlet port and the closed chamber arranged for equalizing the pressure a cross the ratchet piston.

2. The device according to claim 1, wherein the valve mechanism comprises a first one-way valve and a second one-way valve each having one end in fluid communication with the closed chamber and another end in pressure communication with the inlet port, wherein the first and the second one-way valves are arranged in opposite directions.

3. The device according to claim 2, wherein the first and the second valves are configured to equalize pressure in the closed chamber when a predetermined differential pressure value between the wellbore pressure and the pressure is exceeded.

4. The device according to claim 2, wherein the first and the second valves are one-way relief valves.

5. The device according to claim 1, wherein the fluid in the closed chamber is a compressible fluid.

6. The device according to claim 1, wherein the counter mechanism further comprises:

a ratchet movably connected to the ratchet piston, a retaining clip and a retaining member configured to limit movement of the ratchet towards the pressure inlet port.

7. The device according to claim 1, wherein the counter mechanism further comprises:

a retaining shoulder configured to limit the movement of the ratchet piston towards the closed chamber.

8. The device according to claim 1, further comprising:

an activation pin arranged to activate a tool located in a wellbore.

9. The device according to claim 8, wherein the activation pin is arranged to be activated by the ratchet.

10. The device according to claim 6, wherein the ratchet piston is configured to move the ratchet in a direction towards an activation pin and move freely in the opposite direction.

11. The device according to claim 2, wherein the first valve is configured to open when wellbore pressure at the pressure inlet port is a predetermined value greater than the pressure in the closed chamber.

12. The device according to claim 2, wherein the second valve is configured to open when wellbore pressure at the pressure inlet port is a predetermined value less than the pressure in the closed chamber.

13. The device according to claim 1, further comprising pressure equalization channel which extends from the pressure inlet port and beyond the counter mechanism.

14. The device according to claim 5, wherein the compressible fluid in the closed chamber is silicone oil.

15. The device according to claim 1, wherein the valve mechanism is arranged within the ratchet piston.

16. The device according to claim 15, wherein the valve mechanism comprises a valve configured to prevent fluid flow in a first direction from pressure inlet port to the closed chamber and allow fluid flow in a second opposite the first direction.

17. A method of activating a downhole tool with a tool activation device comprising:

a pressure inlet port;

a housing comprising, a counter mechanism with a first end and a second end, wherein the counter mechanism comprises a closed chamber filled with a fluid having a pressure, and a ratchet system comprising a ratchet and a ratchet piston with a first end in pressure communication with the pressure inlet port and a second end in communication with the closed chamber, a valve mechanism interconnecting the pressure inlet port and the closed chamber, the method comprising the steps of;

a) increasing wellbore pressure at the pressure inlet port to push the ratchet means towards an activation pin whereby the ratchet piston compresses the fluid in the closed chamber, and to move the ratchet to a new position, b) retaining the ratchet in the new position by the retaining mechanism; and c) continue increasing wellbore pressure in such that the wellbore pressure is a predetermined pressure difference greater than the pressure in the closed chamber.

18. The method according to claim 17, the method further comprising;

d) open a first valve of the valve mechanism to equalize pressure across the ratchet piston by allowing fluid into the closed chamber;

e) decreasing the wellbore pressure a predetermined pressure difference lower than the pressure in the closed chamber;

f) open a second valve of the valve mechanism to equalize pressure across the ratchet piston by releasing fluid from the closed chamber;

g) repeating steps a) to f) until the ratchet shaft engages with the activation pin and forces the activation pin from its position and activate the downhole tool.

19. The method according to claim 18, wherein in step f), the ratchet piston is pushed back to its start position and the ratchet is retained by the retaining mechanism.

20. The method according to claim 17, the method further comprising the steps of;

h) decreasing the wellbore pressure lower than the pressure in the closed chamber;

i) open a valve of the valve mechanism to equalize pressure across the ratchet piston by releasing fluid from the closed chamber; and j) repeating steps (a-c) and (h-j) until the ratchet shaft engages with the activation pin and forces the activation pin from its position to activate the downhole tool.

* * * * *